US011731235B2

(12) United States Patent
Togashi et al.

(10) Patent No.: US 11,731,235 B2
(45) Date of Patent: Aug. 22, 2023

(54) POLISHING APPARATUS AND POLISHING METHOD

(71) Applicant: EBARA CORPORATION, Tokyo (JP)

(72) Inventors: Shingo Togashi, Tokyo (JP); Makoto Fukushima, Tokyo (JP); Keisuke Namiki, Tokyo (JP); Osamu Nabeya, Tokyo (JP); Satoru Yamaki, Tokyo (JP); Tomoko Owada, Tokyo (JP); Yoshikazu Kato, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 369 days.

(21) Appl. No.: 16/720,624

(22) Filed: Dec. 19, 2019

(65) Prior Publication Data

US 2020/0206867 A1 Jul. 2, 2020

(30) Foreign Application Priority Data

Dec. 27, 2018 (JP) ..... 2018-244440

(51) Int. Cl.
*B24B 37/32* (2012.01)
*B24B 37/20* (2012.01)

(52) U.S. Cl.
CPC ..... *B24B 37/20* (2013.01); *B24B 37/32* (2013.01)

(58) Field of Classification Search
CPC ..... B24B 37/30–34; B24B 49/16
USPC ..... 451/41, 290, 285–288, 397–398
See application file for complete search history.

(56) References Cited

U.S. PATENT DOCUMENTS 5,738,568 A * 4/1998 Jurjevic ..... B24B 37/30 451/41
5,851,136 A * 12/1998 Lee ..... B24B 37/105 451/9
5,908,530 A * 6/1999 Hoshizaki ..... B24B 37/042 156/345.14
6,019,868 A * 2/2000 Kimura ..... B24B 37/32 156/345.14
6,110,025 A * 8/2000 Williams ..... B24B 49/16 451/286
6,217,411 B1 * 4/2001 Hiyama ..... B24B 37/005 451/24

(Continued)

FOREIGN PATENT DOCUMENTS

CN 1728343 A 2/2006
CN 101045286 A 10/2007

(Continued)

*Primary Examiner* — Don M Anderson
*Assistant Examiner* — Jonathan R Zaworski
(74) *Attorney, Agent, or Firm* — BakerHostetler

(57) ABSTRACT

The polishing apparatus includes: a polishing table configured to support a polishing pad having a polishing surface; a rotatable head body having a pressing surface; a retainer ring configured to press the polishing surface and rotatable together with the head body; a rotary ring; a stationary ring; and local-load exerting devices each configured to apply a local load to the stationary ring. The local-load exerting devices include a first pressing member and a second pressing member coupled to the stationary ring. The first pressing member is arranged at an upstream side of the retainer ring in a moving direction of the polishing surface, and the second pressing member is arranged at a downstream side of the retainer ring in the moving direction of the polishing surface.

2 Claims, 7 Drawing Sheets

(56) References Cited

U.S. PATENT DOCUMENTS 6,220,945 B1 * 4/2001 Hirokawa ..... B24B 7/228 451/287
6,234,884 B1 * 5/2001 Inaba ..... B24B 57/02 451/288
6,293,858 B1 * 9/2001 Kimura ..... B24B 37/32 451/287
6,454,637 B1 * 9/2002 Gotkis ..... B24B 37/30 451/60
6,517,422 B2 * 2/2003 Sakamoto ..... B24B 37/32 451/288
6,565,424 B2 * 5/2003 Katagiri ..... B24B 37/042 451/285
6,579,151 B2 * 6/2003 Tseng ..... B24B 37/32 451/11
6,857,950 B2 * 2/2005 Hayashi ..... B24B 49/10 451/397
6,916,234 B2 * 7/2005 Suwabe ..... B24B 37/32 451/186
9,403,255 B2 * 8/2016 Fukushima ..... B24B 37/005
9,662,764 B2 * 5/2017 Fukushima ..... B24B 37/042
9,833,875 B2 * 12/2017 Nabeya ..... B24B 41/007
10,702,972 B2 * 7/2020 Fukushima ..... B24B 37/32
2013/0324012 A1 * 12/2013 Fukushima ..... B24B 37/005 451/1
2014/0370794 A1 * 12/2014 Fukushima ..... B24B 37/32 451/387
2015/0328743 A1 * 11/2015 Nabeya ..... B24B 41/007 451/288

FOREIGN PATENT DOCUMENTS

CN 103447939 A 12/2013
JP 2002-170795 A 6/2002
JP 2002170795 A * 6/2002
JP 2004-510336 A 4/2004
JP 2014-004675 A 1/2014
JP 2015-233131 A 12/2015

* cited by examiner

POLISHING APPARATUS AND POLISHING METHOD

CROSS REFERENCE TO RELATED APPLICATION

This document claims priority to Japanese Patent Application Number 2018-244440 filed Dec. 27, 2018, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique for a surface of the semiconductor device is becoming more important. The most important technique in this surface planarization is chemical mechanical polishing (CMP). This chemical mechanical polishing (which will be hereinafter called CMP) is a process of polishing a substrate, such as a wafer, by placing the substrate in sliding contact with a polishing surface of a polishing pad while supplying a polishing liquid (slurry) containing abrasive grains, such as silica ($SiO_2$), onto the polishing surface.

A polishing apparatus for performing CMP includes a polishing table that supports a polishing pad having a polishing surface, and a polishing head for holding a substrate. Polishing of the substrate using such a polishing apparatus is performed as follows. Slurry is supplied onto the polishing pad while the polishing table is rotated together with the polishing pad. The polishing head presses the substrate against the polishing surface of the polishing pad while the polishing head is rotating the substrate. While the substrate is in sliding contact with the polishing pad in the presence of the slurry, a surface of the substrate is planarized by a combination of a chemical action of the slurry and a mechanical action of abrasive grains contained in the slurry.

During polishing of the substrate, the surface of the substrate is in sliding contact with the rotating polishing pad. As a result, a frictional force acts on the substrate. Thus, in order to prevent the substrate from being moved out of the polishing head during polishing of the substrate, the polishing head includes a retainer ring. This retainer ring is arranged so as to surround the substrate. During polishing of the substrate, the retainer ring presses the polishing pad outside the substrate while the retainer ring is rotating.

In recent years, there has been an increasing demand for more precise control of a polishing profile of a periphery of the substrate, for a reason of achieving various initial film thickness profiles that can be varied according to semiconductor devices and CMP processes, and for a reason of increasing a yield by planarizing a substrate surface including a circumferential edge of the substrate.

It is possible to control a polishing rate in the periphery of the substrate by regulating pressure of the entire retainer ring. However, changing the pressure of the entire retainer ring could result in a change in the polishing rate not only in the periphery of the substrate, but also in other region with a relatively large area. Therefore, it is difficult for the conventional method to precisely control the polishing profile of the periphery of the substrate.

SUMMARY OF THE INVENTION

Therefore, according to embodiments, there are provided a polishing apparatus capable of precisely controlling a polishing profile of a periphery of a substrate, such as a wafer, and a polishing method of polishing a substrate, such as a wafer, using such a polishing apparatus.

Embodiments, which will be described below, relate to a polishing apparatus for polishing a substrate, such as a wafer, and more particularly to a polishing apparatus including a retainer ring surrounding a substrate. Further, embodiments, which will be described below, relate to a polishing method of polishing a substrate, such as a wafer, using such a polishing apparatus.

In an embodiment, there is provided a polishing apparatus comprising: a polishing table configured to support a polishing pad having a polishing surface; a rotatable head body having a pressing surface to press a substrate against the polishing surface; a retainer ring surrounding the pressing surface and rotatable together with the head body, the retainer ring being arranged to press the polishing surface; a rotary ring secured to the retainer ring and rotatable together with the retainer ring; a stationary ring located on the rotary ring; and a plurality of local-load exerting devices each configured to apply a local load to the stationary ring, wherein the local-load exerting devices include: a first pressing member and a second pressing member coupled to the stationary ring; and a first actuator and a second actuator coupled to the first pressing member and the second pressing member, respectively, the first pressing member is arranged at an upstream side of the retainer ring in a moving direction of the polishing surface, and the second pressing member is arranged at a downstream side of the retainer ring in the moving direction of the polishing surface.

In an embodiment, the first pressing member and the second pressing member are located at both sides of a reference linear line passing through a center of the retainer ring and a center of the polishing table.

In an embodiment, the first pressing member and the second pressing member are located on a linear line perpendicular to the reference line and passing through the center of the retainer ring.

In an embodiment, the first pressing member is located within a range of 0°±90°, and the second pressing member is located within a range of 180°±90°, where one of two intersections of a linear line perpendicular to the reference linear line and passing through the center of the retainer ring and a peripheral edge of the retainer ring, located at an upstream side, is defined as an angle of 0 degrees, and the other intersection located at a downstream side is defined as an angle of 180 degrees, and one of two intersections of the reference linear line and the peripheral edge of the retainer ring, located at a center side of the polishing surface, is defined as an angle of 270 degrees, and the other intersection located at a peripheral side of the polishing surface is defined as an angle of 90 degrees.

In an embodiment, the first pressing member is located within a range of 0°±60°, and the second pressing member is located within a range of 180°±60°.

In an embodiment, the first pressing member is located within a range of 0°±30°, and the second pressing member is located within a range of 180°±30°.

In an embodiment, the polishing apparatus further comprises a controller configured to control an operation of the first actuator that regulates the local load applied from the first pressing member to the stationary ring and an operation of the second actuator that regulates the local load applied from the second pressing member to the stationary ring.

In an embodiment, there is provided a method comprising: rotating a polishing table supporting a polishing pad; pressing a substrate against a polishing surface of the polishing pad with a pressing surface of a head body, while rotating the head body; pressing a retainer ring against the polishing surface while rotating the retainer ring together with the head body and the substrate, the retainer ring surrounding the substrate; and polishing the substrate while rotating a rotary ring together with the retainer ring and applying a local load to a stationary ring from a first pressing member or a second pressing member, the rotary ring being secured to the retainer ring, the stationary ring being located on the rotary ring, wherein the first pressing member is arranged at an upstream side of the retainer ring in a moving direction of the polishing surface, and the second pressing member is arranged at a downstream side of the retainer ring in the moving direction of the polishing surface.

In an embodiment, the first pressing member and the second pressing member are located at both sides of a reference linear line passing through a center of the retainer ring and a center of the polishing table.

In an embodiment, the first pressing member and the second pressing member are located on a linear line perpendicular to the reference line and passing through the center of the retainer ring.

In an embodiment, the first pressing member is located within a range of 0°±90°, and the second pressing member is located within a range of 180°±90°, where one of two intersections of a linear line perpendicular to the reference linear line and passing through the center of the retainer ring and a peripheral edge of the retainer ring, located at an upstream side, is defined as an angle of 0 degrees, and the other intersection located at a downstream side is defined as an angle of 180 degrees, and one of two intersections of the reference linear line and the peripheral edge of the retainer ring, located at a center side of the polishing surface, is defined as an angle of 270 degrees, and the other intersection located at a peripheral side of the polishing surface is defined as an angle of 90 degrees.

In an embodiment, the first pressing member is located within a range of 0°± 60°, and the second pressing member is located within a range of 180°±60°.

In an embodiment, the first pressing member is located within a range of 0°±30°, and the second pressing member is located within a range of 180°±30°.

When the local load is applied to each of the upstream side and the downstream side of the stationary ring in the moving direction of the polishing surface, a part of the polishing surface rises and generates an upward local repulsive force. These local repulsive forces act on the periphery of the substrate at different positions in the radial direction of the substrate during polishing of the substrate. Therefore, a polishing rate of the substrate can be locally changed. As a consequence, a polishing profile of the periphery of the substrate can be precisely controlled.

DESCRIPTION OF EMBODIMENTS

Figure 1:
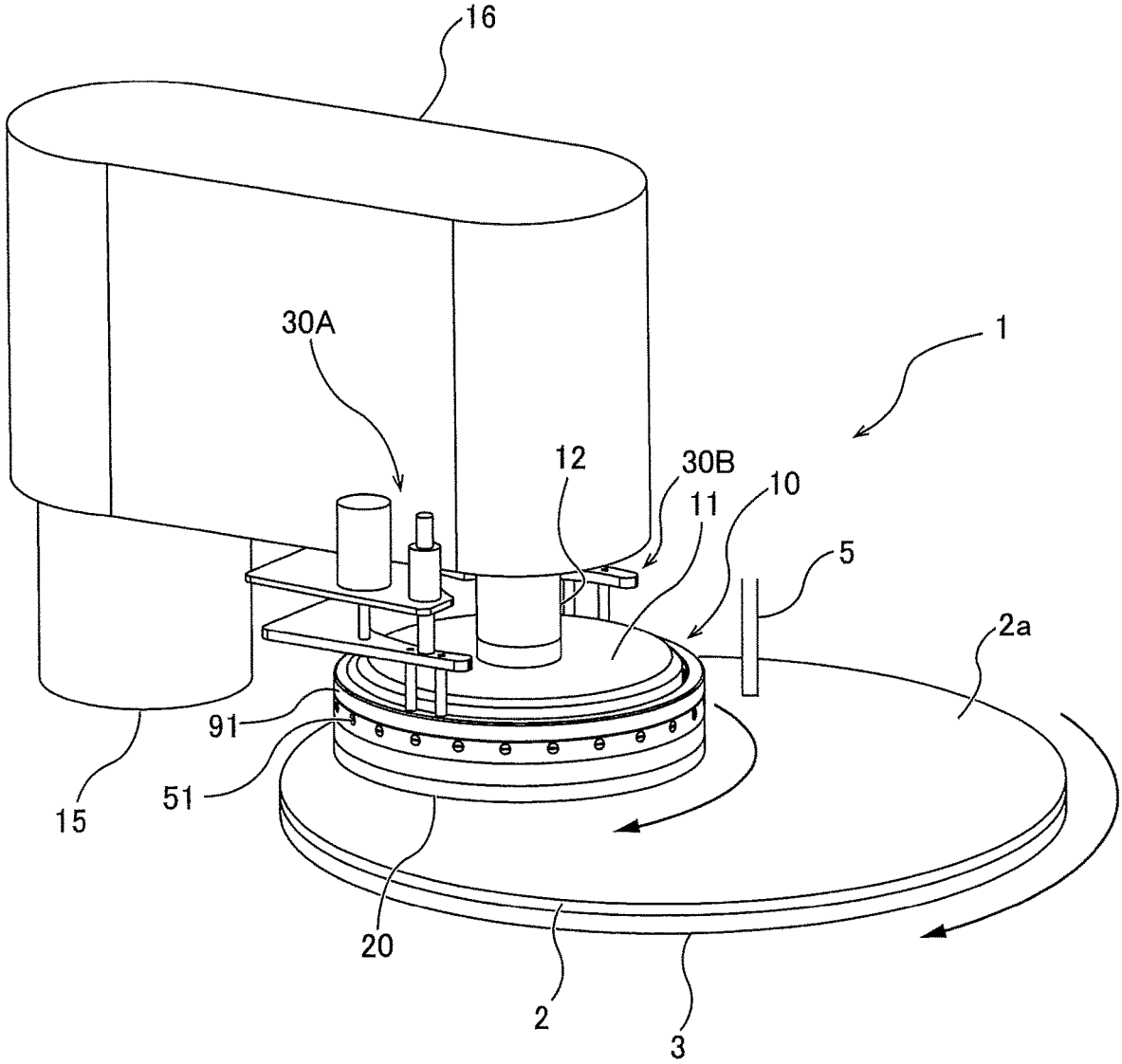
FIG. 1 is a schematic view showing an embodiment of a polishing apparatus.

Embodiments will be described in detail below with reference to the drawings. FIG. 1 is a schematic view showing an embodiment of a polishing apparatus. As shown in FIG. 1, a polishing apparatus 1 includes a polishing head 10 for holding and rotating a wafer which is an example of a substrate, a polishing table 3 for supporting a polishing pad 2 thereon, and a polishing-liquid supply nozzle 5 for supplying a polishing liquid (or slurry) onto the polishing pad 2. The polishing pad 2 has an upper surface which provides a polishing surface 2*a* for polishing the wafer. The polishing pad 2 is configured to be rotatable together with the polishing table 3.

The polishing head 10 is coupled to a lower end of a polishing head shaft 12, which is rotatably held by a head arm 16. In this head arm 16, there are disposed a rotating device (not shown) for rotating the polishing head shaft 12 and an elevating device (not shown) for elevating and lowering the polishing head shaft 12. The polishing head 10 is rotated by the rotating device through the polishing head shaft 12, and is elevated and lowered by the elevating device through the polishing head shaft 12. The head arm 16 is secured to a pivot shaft 15, so that the head arm 16 can move the polishing head 10 outwardly of the polishing table 3 as the pivot shaft 15 rotates.

The polishing head 10 is configured to hold the wafer on its lower surface by vacuum suction. The polishing head 10 and the polishing table 3 (or the polishing pad 2) rotate in the same direction as indicated by arrows. In this state, the polishing head 10 presses the wafer against the polishing surface 2*a* of the polishing pad 2. The polishing liquid is supplied from the polishing-liquid supply nozzle 5 onto the polishing surface 2*a* of the polishing pad 2, so that the wafer is polished by sliding contact with the polishing surface 2*a* in the presence of the polishing liquid.

The polishing head 10 includes a head body 11 for pressing the wafer against the polishing pad 2, and a retainer ring 20 arranged so as to surround the wafer. The head body 11 and the retainer ring 20 are configured to be rotatable together with the polishing head shaft 12. The retainer ring 20 is configured to be movable in vertical directions independently of the head body 11. The retainer ring 20 projects radially outwardly from the head body 11. During polishing of the wafer, the retainer ring 20 contacts the polishing surface 2*a* of the polishing pad 2, and presses the polishing pad 2 outside the wafer while the retainer ring 20 is rotating.

The polishing head 10 further includes a rotary ring 51 in which a plurality of rollers (which will be discussed later) are arranged, and a stationary ring 91. The rotary ring 51 is fixed to an upper surface of the retainer ring 20, and is configured to be rotatable together with the retainer ring 20. The stationary ring 91 is located on the rotary ring 51. The rotary ring 51 rotates together with the retainer ring 20, while the stationary ring 91 does not rotate and remains stationary.

The polishing apparatus 1 further includes a first local-load exerting device 30A for applying a local load to a part of the retainer ring 20, and a second local-load exerting device 30B for applying a local load to a part of the retainer ring 20. The local-load exerting devices 30A, 30B are located above the retainer ring 20. The local-load exerting devices 30A, 30B are fixed to the head arm 16. While the retainer ring 20 rotates about its central axis during polishing of the wafer, the local-load exerting devices 30A, 30B do not rotate together with the retainer ring 20 and remain stationary. The stationary ring 91 is coupled to the local-load exerting devices 30A, 30B. The first local-load exerting device 30A is arranged at an upstream side of the retainer ring 20 in the moving direction of the polishing surface 2*a* of the polishing pad 2 (i.e., arranged at one side of the retainer ring 20 into which the polishing surface 2*a* moves). The second local-load exerting device 30B is arranged at a downstream side of the retainer ring 20 in the moving direction of the polishing surface 2*a* of the polishing pad 2 (i.e., arranged at the opposite side of the retainer ring 20 from which the polishing surface 2*a* moves out).

Figure 2:
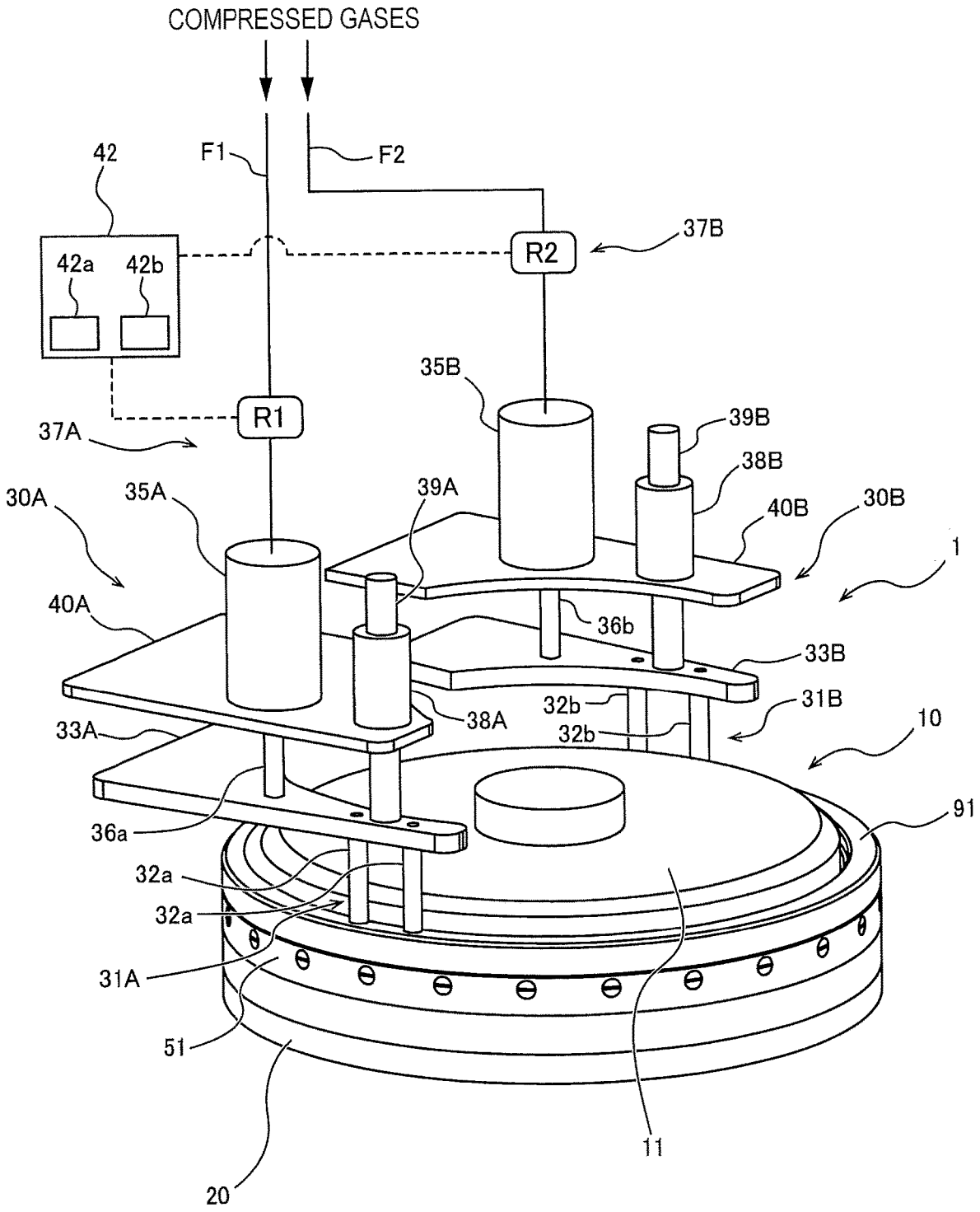
FIG. 2 is a perspective view of local-load exerting devices.

FIG. 2 is a perspective view of the local-load exerting devices 30A, 30B. As shown in FIG. 2, the local-load exerting devices 30A, 30B include pressing members 31A, 31B each for applying a downward local load to the stationary ring 91, bridges 33A, 33B, air cylinders 35A, 35B each for generating a downward force, pressure regulators R1, R2 for regulating pressures of compressed gases in the air cylinders 35A, 35B, linear guides 38A, 38B, guide rods 39A, 39B, and unit bases 40A, 40B.

Specifically, the first local-load exerting device 30A includes the first pressing member 31A, the first bridge 33A, the first air cylinder 35A, the first pressure regulator R1, the first linear guide 38A, the first guide rod 39A, and the first unit base 40A. The second local-load exerting device 30B includes the second pressing member 31B, the second bridge 33B, the second air cylinder 35B, the second pressure regulator R2, the second linear guide 38B, the second guide rod 39B, and the second unit base 40B.

A piston rod 36*a* of the first air cylinder 35A is coupled to the first pressing member 31A through the first bridge 33A, and an end portion of the first pressing member 31A is coupled to the stationary ring 91. Therefore, the force generated by the first air cylinder 35A is transmitted to the first pressing member 31A, and the first pressing member 31A applies the local load to a part of the stationary ring 91. Similarly, a piston rod 36*b* of the second air cylinder 35B is coupled to the second pressing member 31B through the second bridge 33B, and an end portion of the second pressing member 31B is coupled to the stationary ring 91. Therefore, the force generated by the second air cylinder 35B is transmitted to the second pressing member 31B, and the second pressing member 31B applies the local load to a part of the stationary ring 91.

In this embodiment, a combination of the first air cylinder 35A and the first pressure regulator R1 constitutes a first actuator 37A for regulating the local load applied from the first pressing member 31A to the stationary ring 91, and a combination of the second air cylinder 35B and the second pressure regulator R2 constitutes a second actuator 37B for regulating the local load applied from the second pressing member 31B to the stationary ring 91. In one embodiment, the first actuator 37A and the second actuator 37B may be each composed of a combination of a servomotor, a ball screw mechanism, and a motor driver.

The first pressing member 31A includes two push rods 32*a*, and the second pressing member 31B includes two push rods 32*b*. The push rods 32*a* and the push rods 32*b* are coupled to the stationary ring 91. The first pressing member 31A is coupled to the stationary ring 91 at a position upstream of the retainer ring 20 in the moving direction of the polishing surface 2*a* of the polishing pad 2, and the second pressing member 31B is coupled to the stationary ring 91 at a position downstream of the retainer ring 20 in the moving direction of the polishing surface 2*a* of the polishing pad 2. In other words, the first pressing member 31A is arranged to apply the local load to an upstream-side portion of the stationary ring 91 in the moving direction of the polishing surface 2*a* of the polishing pad 2, and the second pressing member 31B is arranged to apply the local load to a downstream-side portion of the stationary ring 91 in the moving direction of the polishing surface 2*a* of the polishing pad 2.

The local-load exerting devices 30A, 30B are fixed to the head arm 16 through the unit bases 40A, 40B, respectively. Therefore, during polishing of the wafer, the polishing head 10 and the wafer are rotating, while the local-load exerting devices 30A, 30B remain stationary. Similarly, during polishing of the wafer, the rotary ring 51 is rotating together with the polishing head 10, while the stationary ring 91 remains stationary.

The local-load exerting devices 30A, 30B have the same construction. The following descriptions relate to the first local-load exerting device 30A, but are applied to the second local-load exerting device 30B as well. The first air cylinder 35A and the first linear guide 38A are mounted to the first unit base 40A. The piston rod 36*a* of the first air cylinder 35A and the first guide rod 39A are coupled to the first bridge 33A. The first guide rod 39A is vertically movably supported by the first linear guide 38A with low friction. The first linear guide 38A allows the first bridge 33A to move smoothly in the vertical directions without being inclined.

The air cylinders 35A, 35B are coupled to a compressed-gas supply source (not shown) through gas delivery lines F1, F2. The pressure regulators R1, R2 are attached to the gas delivery lines F1, F2, respectively. Compressed gases from the compressed-gas supply source are supplied through the pressure regulators R1, R2 into the air cylinders 35A, 35B, respectively and independently.

The pressure regulators R1, R2 are configured to regulate the pressures of the compressed gases in the air cylinders 35A, 35B, respectively. The pressure regulators R1, R2 can change independently the pressures of the compressed gases in the air cylinders 35A, 35B, so that the air cylinders 35A, 35B can generate the forces independently of each other.

The polishing apparatus 1 further includes a controller 42. The controller 42 includes a memory 42*a* and an arithmetic device 42*b* therein. The arithmetic device 42*b* includes a CPU (central processing unit), a GPU (graphic processing unit), or the like for performing arithmetic operations according to instructions contained in a program stored in the memory 42*a*. The memory 42*a* includes a main memory (for example, a random access memory) which is accessible by the arithmetic device 42*b*, and an auxiliary memory (for example, a hard disk drive or a solid-state drive) that stores data and programs therein.

The pressure regulators R1, R2 are electrically connected to the controller 42. During polishing of the wafer W, the controller 42 instructs one of the pressure regulators R1, R2 to regulate the pressure of the compressed gas in the air cylinder 35A or the air cylinder 35B.

The forces generated by the air cylinders 35A, 35B are transmitted to the bridges 33A, 33B, respectively. The bridges 33A, 33B are coupled to the stationary ring 91 through the pressing members 31A, 31B, and the pressing members 31A, 31B transmit the forces of the air cylinders 35A, 35B applied to the bridges 33A, 33B to the stationary ring 91. Specifically, the first pressing member 31A presses a part of the stationary ring 91 with a local load corresponding to the force generated by the first air cylinder 35A, and the second pressing member 31B presses a part of the stationary ring 91 with a local load corresponding to the force generated by the second air cylinder 35B.

Each of the local-load exerting devices 30A, 30B exerts the downward local load on a part of the retainer ring 20 through the stationary ring 91 and the rotary ring 51. Specifically, the downward local load is transmitted through the stationary ring 91 and the rotary ring 51 to the retainer ring 20.

The polishing apparatus 1 polishes the wafer while rotating the rotary ring 51 secured to the retainer ring 20 together with the retainer ring 20 and applying the local load to the stationary ring 91 from the first pressing member 31A or the second pressing member 31B. During polishing of the wafer, the rotating retainer ring 20 contacts the polishing surface 2*a* of the polishing pad 2, while pressing the polishing pad 2 outside the wafer and exerting the downward local load on a part of the polishing surface 2*a*.

Figure 3:
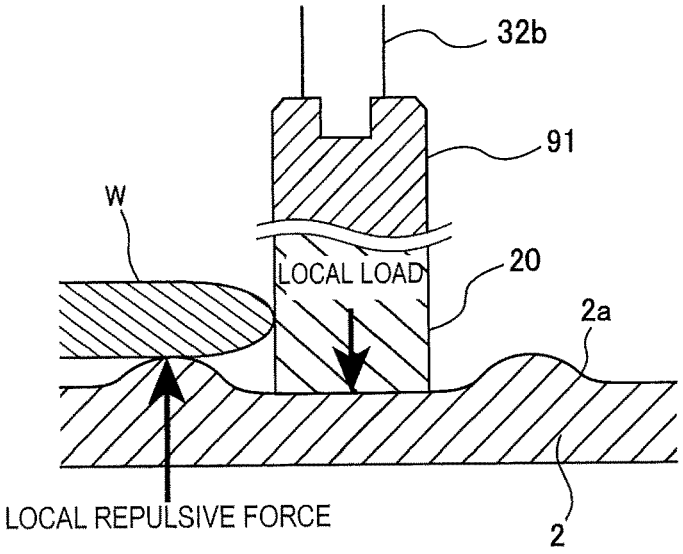
FIG. 3 is a vertical cross-sectional view schematically showing a state in which a retainer ring presses a polishing surface.

As shown in FIG. 3, when the retainer ring 20 applies the downward local load to a part of the polishing surface 2*a*, a part of the polishing surface 2*a* rises upward. The upwardly-raised polishing surface 2*a* applies in turn an upward local load to the wafer W. In the following descriptions, this upward local load is referred to as a local repulsive force. In FIG. 3, for illustrative purpose, only the raised portion of the polishing surface 2*a* is in contact with the wafer W, but an entire lower surface (i.e., a surface to be polished) of the wafer W is in contact with the polishing surface 2*a* during actual polishing. A polishing rate of a portion of the wafer W to which the local repulsive force is applied increases. A magnitude of the local repulsive force depends on a magnitude of the force with which the retainer ring 20 presses the polishing pad 2, and the polishing rate changes depending on the magnitude of the local repulsive force. Specifically, the greater the local repulsive force, the higher the polishing rate. A position where the local repulsive force is generated depends on a position where the retainer ring 20 applies the local load to the polishing surface 2*a*.

Therefore, the wafer is polished, while the local load is applied from the first pressing member 31A or the second pressing member 31B to the stationary ring 91 to thereby generate the local repulsive force corresponding to the local load, so that the polishing rate of the portion of the wafer receiving the local repulsive force can be changed. For example, when the local load applied from the first pressing member 31A is to be increased, the controller 42 instructs the pressure regulator R1 to increase the pressure of the compressed gas in the air cylinder 35A. When the local load applied from the second pressing member 31B is to be increased, the controller 42 instructs the pressure regulator R2 to increase the pressure of the compressed gas in the air cylinder 35B.

Figure 4:
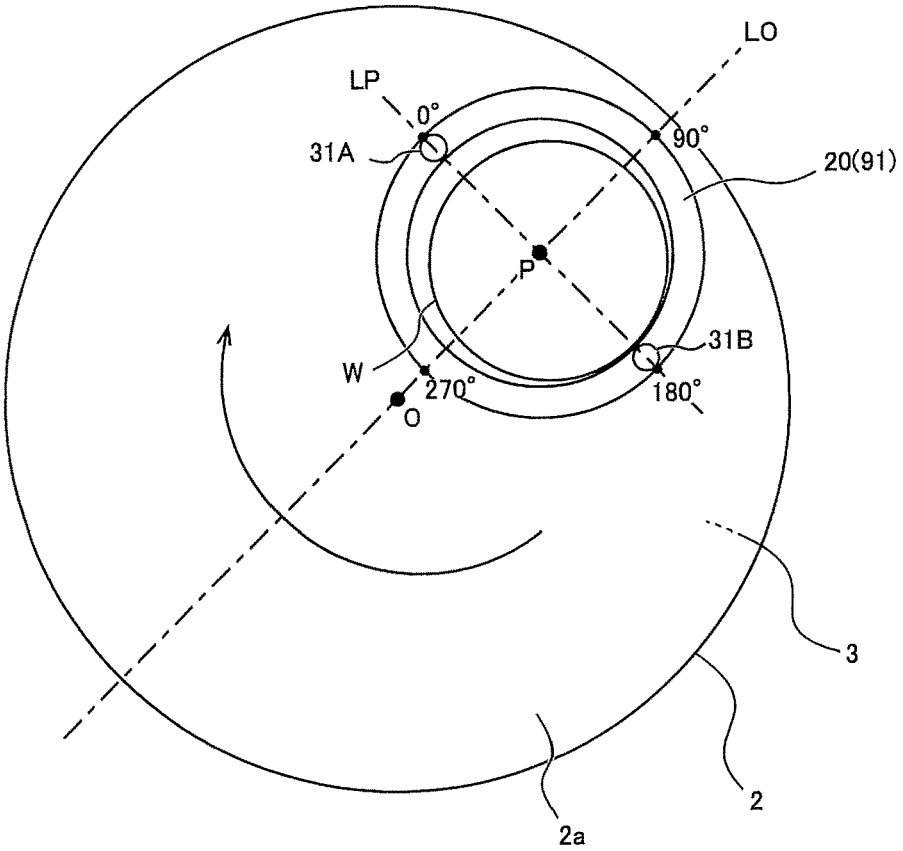
FIG. 4 is a top view schematically showing a positional relationship between a wafer and pressing members during polishing of the wafer.
Figure 5:
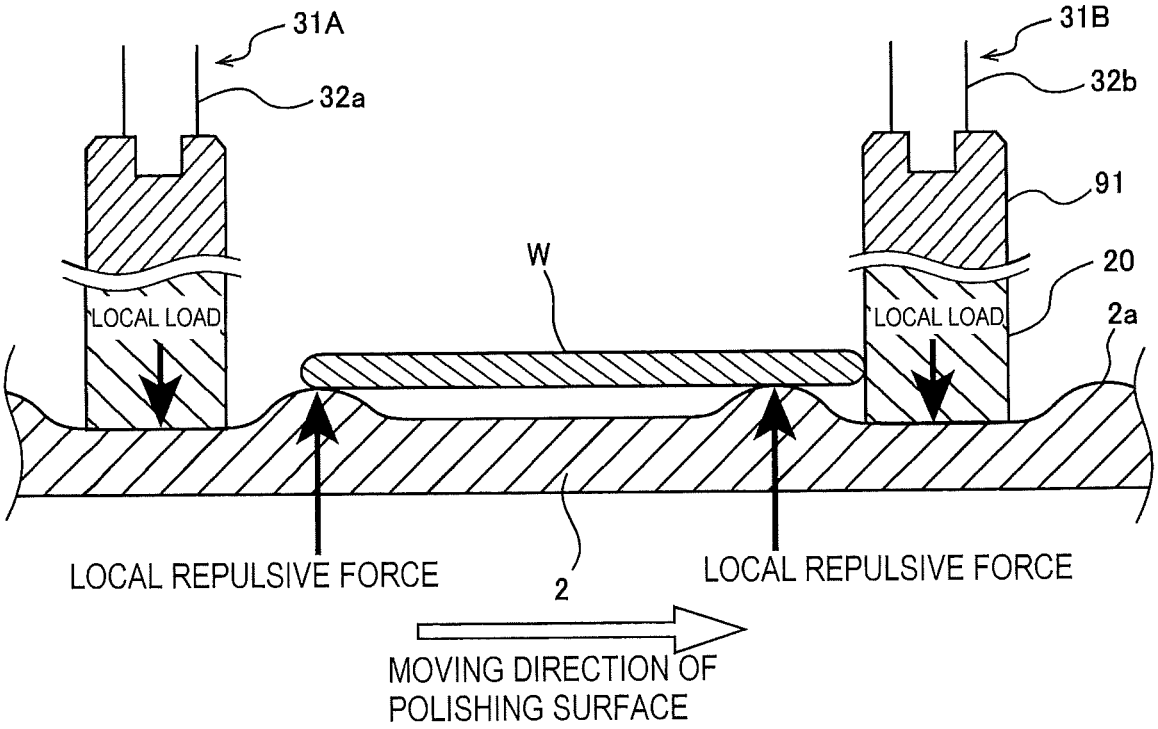
FIG. 5 is a vertical cross-sectional view schematically showing a positional relationship between the wafer and local repulsive forces.

FIG. 4 is a top view schematically showing a positional relationship between the wafer W and the pressing members 31A, 31B during polishing of the wafer W, and FIG. 5 is a vertical cross-sectional view schematically showing a positional relationship between the wafer W and the local repulsive forces. An arrow in FIG. 4 indicates the moving direction of the polishing surface 2*a*. Where a linear line passing through a center P of the retainer ring 20 and a center O of the polishing table 3 is referred to a reference linear line LO, the first pressing member 31A and the second pressing member 31B are located at both sides of the reference linear line LO. More specifically, the first pressing member 31A is located upstream of the reference linear line LO in the moving direction of the polishing surface 2*a*, and the second pressing member 31B is located downstream of the reference linear line LO in the moving direction of the polishing surface 2*a*. In this embodiment, the first pressing member 31A and the second pressing member 31B are located on a linear line LP perpendicular to the reference linear line LO and passing through the center P of the retainer ring 20. As shown in FIG. 4, during the polishing, the rotating wafer W is biased toward a downstream side inside the retainer ring 20. Therefore, as shown in FIG. 5, a position of the local repulsive force relative to the wafer W when the local load is applied from the first pressing member 31A to the stationary ring 91 is different from a position of the local repulsive force relative to the wafer W when the local load is applied from the second pressing member 31B to the stationary ring 91. In FIG. 5, for illustrative purpose, only the raised portions of the polishing surface 2*a* are in contact with the wafer W, but an entire lower surface (i.e., a surface to be polished) of the wafer W is in contact with the polishing surface 2*a* during actual polishing.

The polishing surface 2*a* can be divided into an upstream side and a downstream side, which are located upstream and downstream of the reference linear line LO with respect to the moving direction. In other words, the upstream side and the downstream side with respect to the reference linear line LO are an upstream side and a downstream side of the retainer ring 20 and the stationary ring 91 with respect to the moving direction of the polishing surface 2*a*.

In FIG. 4, one of two intersections of the linear line LP and a peripheral edge of the retainer ring 20, located at an upstream side, is defined as an angle of 0 degrees, and the other intersection located at a downstream side is defined as an angle of 180 degrees. One of two intersections of the reference linear line LO and the peripheral edge of the retainer ring 20, located at a center side of the polishing surface, is defined as an angle of 270 degrees, and the other intersection located at a peripheral side of the polishing surface is defined as an angle of 90 degrees. In one embodiment, the first pressing member 31A may be located within a range of 0°±30°, and the second pressing member 31B may be located within a range of 180°±30°. Furthermore, in one embodiment, the first pressing member 31A may be located within a range of 0°±60°, and the second pressing member 31B may be located within a range of 180°±60°. Furthermore, in one embodiment, the first pressing member 31A may be located within a range of 0°±90°, and the second pressing member 31B may be located within a range of 180°±90°.

In one embodiment, an inner diameter of the retainer ring 20 may be changed, so that the relative position of the local repulsive force with respect to the wafer W can be changed.

With the arrangement of the first pressing member 31A and the second pressing member 31B as discussed in each of the above-described embodiments, a polishing rate of an outer region in the periphery of the wafer W can be increased when the local load is applied from the first pressing member 31A to the stationary ring 91 during polishing of the wafer W, and a polishing rate of an inner region in the periphery of the wafer W can be increased when the local load is applied from the second pressing member 31B to the stationary ring 91 during polishing of the wafer W. Therefore, a polishing profile of the periphery of the wafer W can be precisely controlled.

According to each of the above-described embodiments, by applying the local load to each of the upstream side and the downstream side of the stationary ring 91 in the moving direction of the polishing surface 2*a*, the local repulsive forces acting on different positions of the wafer W can be generated, so that the polishing rate in the periphery of the wafer can be locally changed. As a consequence, the polishing profile of the periphery of the wafer can be precisely controlled.

Figure 6:
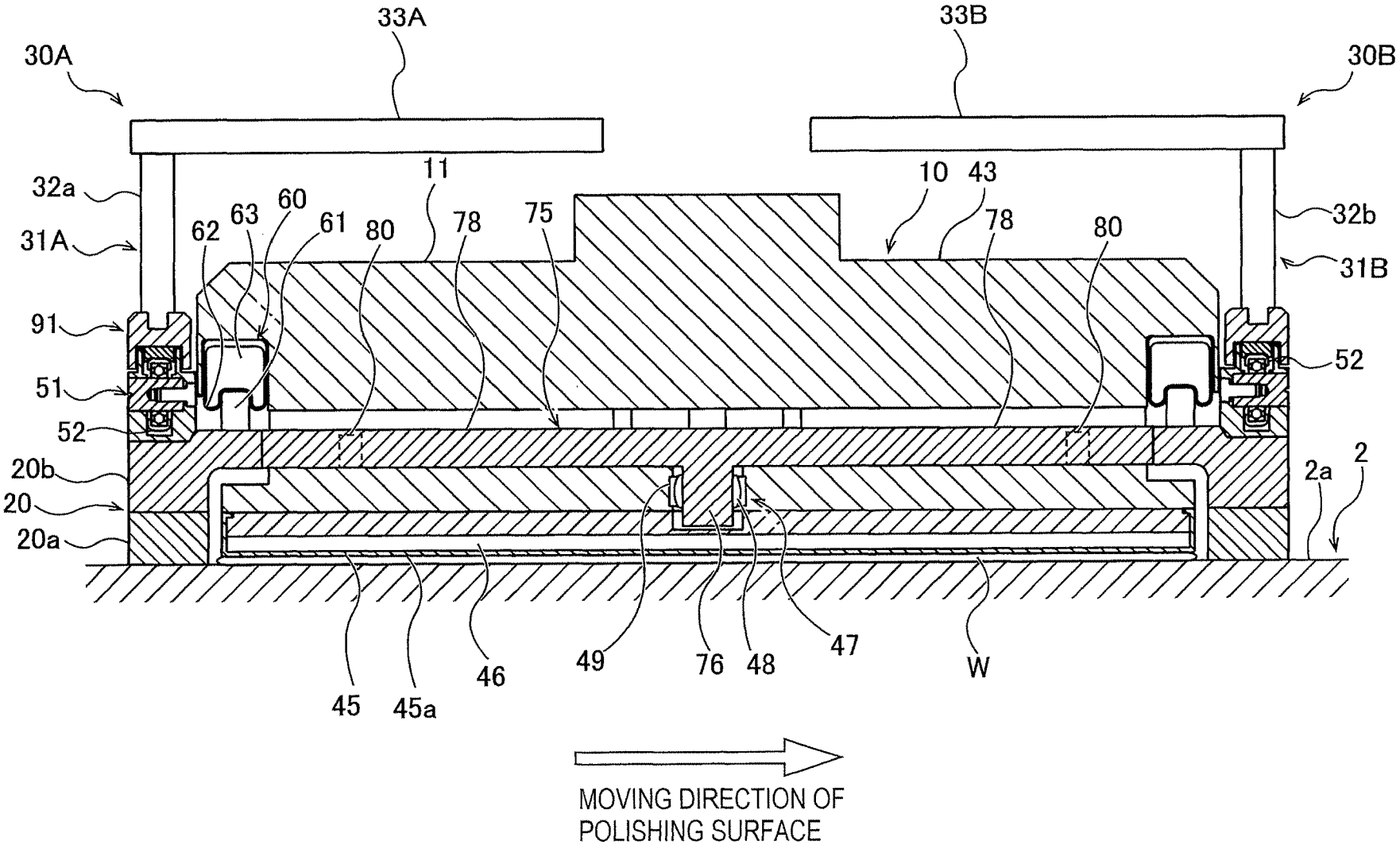
FIG. 6 is a cross-sectional view of a polishing head.

Next, the details of the polishing head 10 will be described. FIG. 6 is a cross-sectional view of the polishing head 10. This polishing head 10 includes the head body 11 and the retainer ring 20. The head body 11 includes a carrier 43 coupled to the polishing head shaft 12 (see FIG. 1), an elastic membrane (or a membrane) 45 attached to a lower surface of the carrier 43, and a spherical bearing 47 supporting the retainer ring 20 while allowing the retainer ring 20 to tilt and move in the vertical directions relative to the carrier 43. The retainer ring 20 is coupled to and supported by the spherical bearing 47 through a coupling member 75. This coupling member 75 is disposed in the carrier 43 and is vertically movable in the carrier 43.

The elastic membrane 45 has a lower surface that provides a pressing surface 45*a*. This pressing surface 45*a* is brought into contact with an upper surface (a surface at an opposite side from a surface to be polished) of the wafer W. The elastic membrane 45 has a plurality of through-holes (not shown). A pressure chamber 46 is formed between the carrier 43 and the elastic membrane 45. This pressure chamber 46 is in a fluid communication with a pressure regulator (not shown). When a pressurized fluid (e.g., a pressurized air) is supplied into the pressure chamber 46, the pressing surface 45*a* of the elastic membrane 45 receives the pressure of the fluid in the pressure chamber 46, thus pressing the wafer W against the polishing surface 2*a* of the polishing pad 2. When negative pressure is developed in the pressure chamber 46, the wafer W is held on the pressing surface 45*a* of the elastic membrane 45 by the vacuum suction. In one embodiment, a plurality of pressure chambers may be provided between the carrier 43 and the elastic membrane 45.

The retainer ring 20 is arranged so as to surround the wafer W and the pressing surface 45*a* of the elastic membrane 45. The retainer ring 20 has a ring member 20*a* that is to touch the polishing pad 2, and a drive ring 20*b* fixed to an upper portion of the ring member 20*a*. The ring member 20*a* is secured to the drive ring 20*b* by a plurality of bolts (now shown). The ring member 20*a* is arranged so as to surround the peripheral edge of the wafer W and the pressing surface 45*a* of the elastic membrane 45.

The coupling member 75 includes a shaft portion 76 located in the center of the head body 11, and a plurality of spokes 78 extending radially from the shaft portion 76. The shaft portion 76 extends in the vertical direction through the spherical bearing 47 that is located in the center of the head body 11. The shaft portion 76 is supported by the spherical bearing 47 such that the shaft portion 76 can be movable in the vertical directions. The drive ring 20*b* is connected the spokes 78. With these configurations, the coupling member 75 and the retainer ring 20, which is coupled to the coupling member 75, can move relative to the head body 11 in the vertical directions.

The spherical bearing 47 includes an inner race 48, and an outer race 49 that slidably supports an outer circumferential surface of the inner race 48. The inner race 48 is coupled to the retainer ring 20 through the coupling member 75. The outer race 49 is fixed to the carrier 43. The shaft portion 76 of the coupling member 75 is supported by the inner race 48 such that the shaft portion 76 can move in the vertical directions. The retainer ring 20 is tiltably supported by the spherical bearing 47 through the coupling member 75.

The spherical bearing 47 is configured to allow the retainer ring 20 to move in the vertical directions and tilt, while restricting a lateral movement (horizontal movement) of the retainer ring 20. During polishing of the wafer W, the retainer ring 20 receives from the wafer W a lateral force (an outward force in the radial direction of the wafer W) that is generated due to the friction between the wafer W and the polishing pad 2. This lateral force is bore or received by the spherical bearing 47. In this manner, the spherical bearing 47 serves as a bearing device configured to receive the lateral force (the outward force in the radial direction of the wafer W) that is applied from the wafer W to the retainer ring 20 due to the friction between the wafer W and the polishing pad 2 during polishing of the wafer W, while restricting the lateral movement of the retainer ring 20 (i.e., fixing the horizontal position of the retainer ring 20).

Plural pairs of drive collars 80 are fixed to the carrier 43. Each pair of drive collars 80 are arranged on both sides of each spoke 78. The rotation of the carrier 43 is transmitted through the drive collars 80 to the retainer ring 20, so that the head body 11 and the retainer ring 20 can rotate together. The drive collars 80 are just in contact with the spokes 78 and do not prevent the vertical movement and the tilt of the coupling member 75 and the retainer ring 20.

The upper portion of the retainer ring 20 is coupled to an annular retainer-ring pressing mechanism 60, which is configured to exert a uniform downward load on an entire upper surface of the retainer ring 20 (more specifically, an upper surface of the drive ring 20*b*) to thereby press a lower surface of the retainer ring 20 (i.e., a lower surface of the ring member 20*a*) against the polishing surface 2*a* of the polishing pad 2.

The retainer-ring pressing mechanism 60 includes an annular piston 61 secured to the upper portion of the drive ring 20*b*, and an annular rolling diaphragm 62 connected to an upper surface of the piston 61. The rolling diaphragm 62 forms a pressure chamber 63 therein. This pressure chamber 63 is coupled to a pressure regulator (not shown). When a pressurized fluid (e.g., pressurized air) is supplied into the pressure chamber 63, the rolling diaphragm 62 pushes down the piston 61, which in turn pushes down the entirety of the retainer ring 20. In this manner, the retainer-ring pressing mechanism 60 presses the lower surface of the retainer ring 20 against the polishing surface 2*a* of the polishing pad 2.

Figure 7:
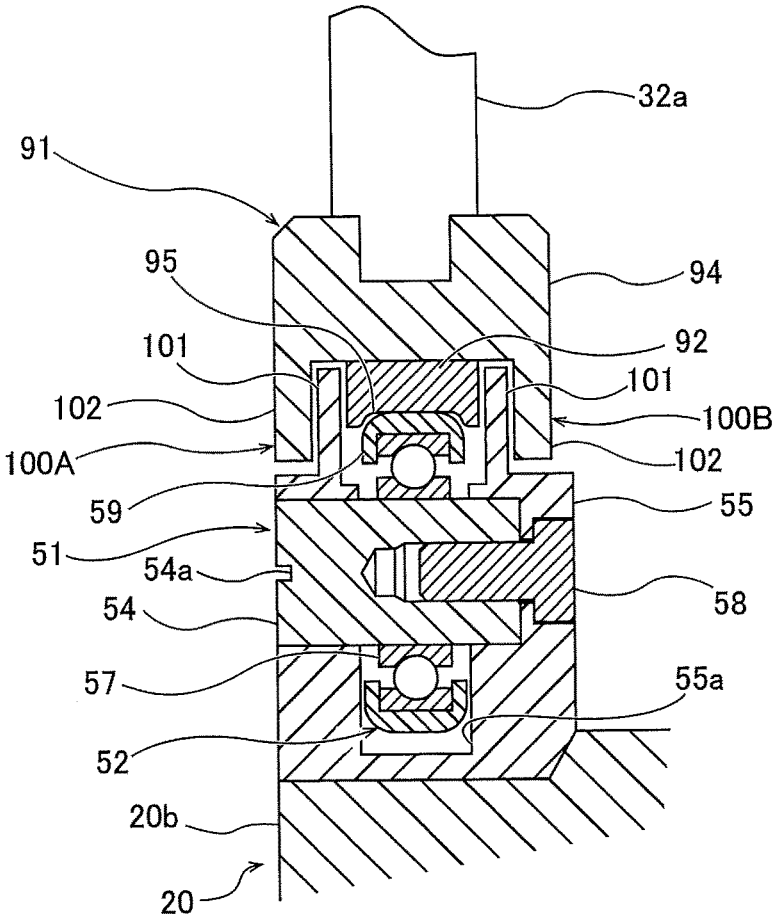
FIG. 7 is a cross-sectional view of a rotary ring and a stationary ring.

FIG. 7 is a cross-sectional view of the rotary ring 51 and the stationary ring 91. The rotary ring 51 includes a plurality of rollers 52, roller shafts 54 that support the rollers 52 respectively, and a roller housing 55 to which the roller shafts 54 are fixed. In FIG. 7, only one roller 52 and one roller shaft 54 are depicted. The roller housing 55 has an annular shape and is fixed to the upper surface of the retainer ring 20. Each roller 52 has a bearing 57 mounted to the roller shaft 54 so that the roller 52 can rotate around the roller shaft 54.

The stationary ring 91 includes an annular rail 92 which is in contact with tops of the rollers 52, and an annular rail base 94 to which the annular rail 92 is fixed. An annular groove 95 is formed in a lower surface of the annular rail 92, and the tops of the rollers 52 are in contact with the annular groove 95. The rollers 52 are rotatable while being in rolling contact with the annular rail 92. The push rods 32*a*, 32*b* (the push rods 32*b* are not shown) are coupled to the top portion of the rail base 94.

The roller shaft 54 that extends through an inner race of the bearing 57 of each roller 52 is supported by an inner wall and an outer wall of the roller housing 55 and is fixed by a screw 58 inserted into the inner wall. Thus, a female screw is formed in the roller shaft 54. A groove 54*a*, into which a flathead screwdriver fits to avoid free spinning of the screw 58 upon tightening of it, is formed on the opposite side of the screw 58 from the female screw. The rotary ring 51 is placed on the upper surface of the drive ring 20*b* of the retainer ring 20. The relative positions of the drive ring 20*b* and the rotary ring 51 are fixed by positioning pins (not shown) so that the rotary ring 51 does not slip relative to the retainer ring 20.

Each roller 52 includes the bearing 57 mounted to the roller shaft 54, and a wheel 59 secured to an outer race of the bearing 57. The wheel 59 is formed of a resin having a high abrasion resistance, such as polyacetal, PET (polyethylene terephthalate), PPS (polyethylene sulfide), or MC Nylon (registered trademark). The annular rail 92 is preferably formed of a metal having a high corrosion resistance, such as stainless steel (SUS 304). A single-row deep-groove ball bearing is used as the bearing 57. The wheel 59 is mounted to the bearing 57 by pressing the outer race of the bearing 57 into the resin wheel 59.

An annular recess 55*a* is formed in the roller housing 55, and the multiple rollers 52 are housed in this annular recess 55*a*. The lower surface and both side surfaces of each roller 52 are surrounded by the annular recess 55*a*. Seals 100A, 100B are disposed between the roller housing 55 of the rotary ring 51 and the rail base 94 of the stationary ring 91. More specifically, the outer seal 100A is located outside the annular rail 92, and the inner seal 100B is located inside the annular rail 92. There is no opening in both side surfaces and a bottom surface that form the annular recess 55*a*, and the seals 100A, 100B are provided between the stationary ring 91 and the rotary ring 51. Therefore, wear particles, generated from the rollers 52 and the annular rail 92, are confined in the annular recess 55*a* and do not fall onto the polishing pad 2.

In the embodiment illustrated in FIG. 7, the outer seal 100A and the inner seal 100B are labyrinth seals. The outer seal 100A includes a first circumferential wall 101 located outside the annular rail 92, and a second circumferential wall 102 located outside the first circumferential wall 101. The first circumferential wall 101 extends upward from the roller housing 55 and is formed integrally with the roller housing 55. The second circumferential wall 102 extends downward from the rail base 94 and is formed integrally with the rail base 94. A very small gap is formed between the first circumferential wall 101 and the second circumferential wall 102. Likewise, the inner seal 100B includes a first circumferential wall 101 located inside the annular rail 92, and a second circumferential wall 102 located inside the first circumferential wall 101.

Figure 8:
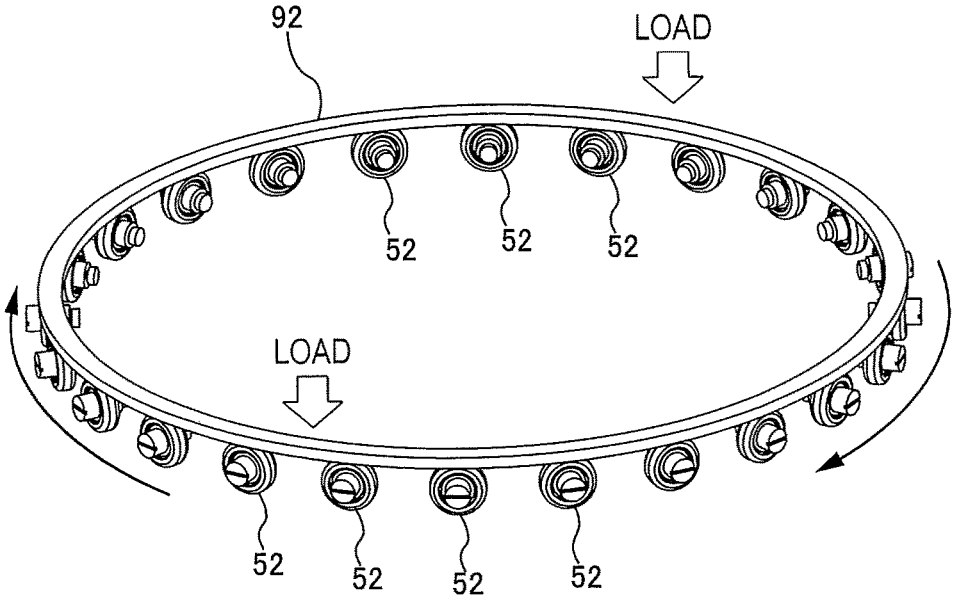
FIG. 8 is a perspective view of rollers and an annular rail.
Figure 9:
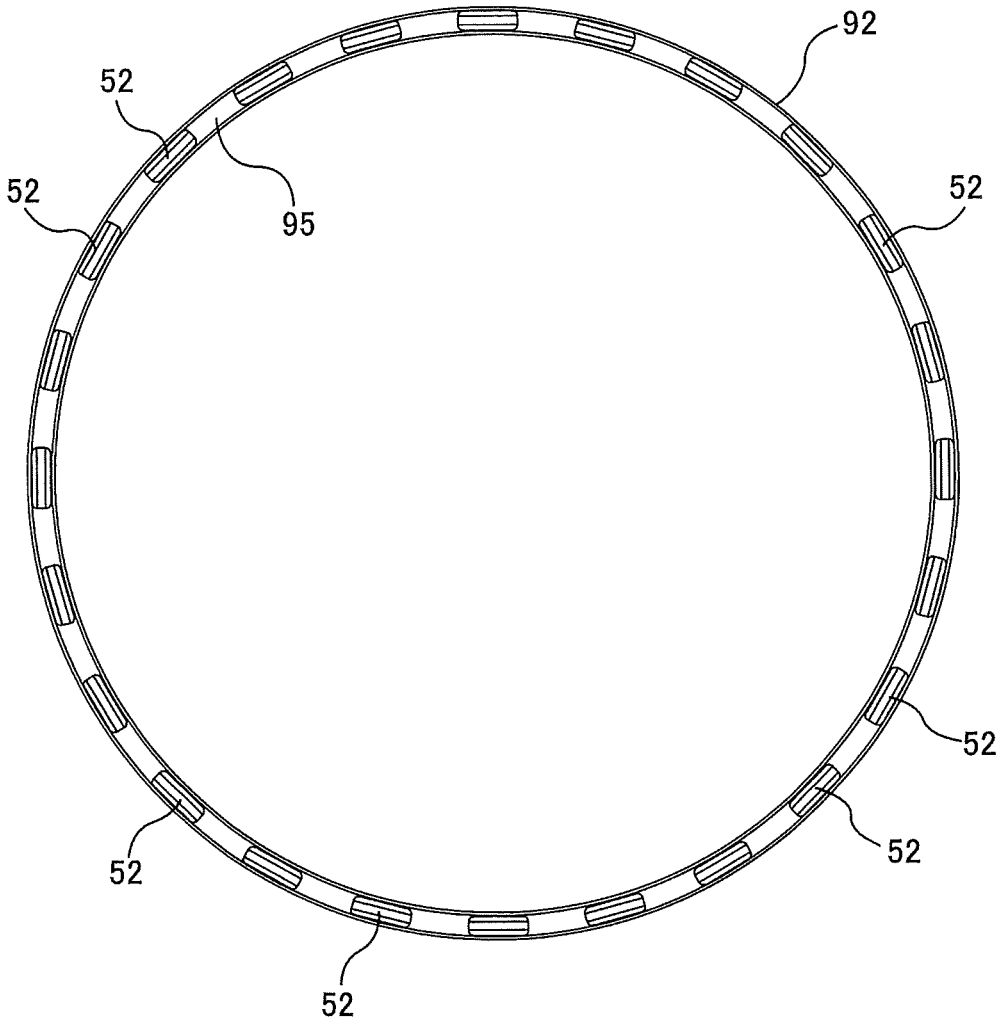
FIG. 9 is a diagram of the rollers and the annular rail of FIG. 8, as viewed from below.

FIG. 8 is a perspective view of the rollers 52 and the annular rail 92, and FIG. 9 is a diagram of the rollers 52 and the annular rail 92 of FIG. 8, as viewed from below. In this embodiment the rotary ring 51 has 24 rollers 52. During polishing of a wafer, the rollers 52 rotate together with the retainer ring 20, while the annular rail 92 remains stationary. Accordingly, the rollers 52 make rolling contact with the annular rail 92. With a construction of the roller 52 described with reference to FIG. 7, the roller 52 can rotate smoothly and can transmit a load without damaging the annular rail 92. The load of the first local-load exerting device 30A and the load of the second local-load exerting device 30B are transmitted from the annular rail 92 to the rollers 52. Each roller 52 receives the load of the first local-load exerting device 30A or the load of the second local-load exerting device 30B only when the roller 52 passes a point of application of the load.

The number of rollers 52 is determined based on the diameter of the roller 52 and the diameter of the annular rail 92. To achieve a smooth transmission of the load, it is preferred to use as many rollers 52 as possible so as to minimize a distance between adjacent rollers 52. Each roller 52 has a smooth circumferential surface, and is in contact with the annular rail 92 in a wide contact area so that the roller 52 can transmit a larger load. The annular rail 92 is placed on the rollers 52. The rollers 52 make rolling contact with the annular rail 92. A lateral position of the annular rail 92 is guided by contact between a corner, having a curved cross-sectional shape, of each roller 52 and a corner, having a curved cross-sectional shape, of the annular rail 92. The load of the first local-load exerting device 30A and the load of the second local-load exerting device 30B are mainly transmitted from the annular rail 92 to the circumferential surface of each roller 52.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A method comprising:

rotating a polishing table supporting a polishing pad;

pressing a substrate against a polishing surface of the polishing pad with a pressing surface of a head body, while rotating the head body;

pressing a retainer ring against the polishing surface while rotating the retainer ring together with the head body and the substrate, the retainer ring surrounding the substrate, the retainer ring having an inner diameter larger than a diameter of the substrate; and polishing the substrate while rotating a rotary ring together with the retainer ring and applying a local load to a stationary ring from a first pressing member or a second pressing member of dual pressing members consisting of the first pressing member and the second pressing member, the first pressing member and the second pressing member being located on a linear line passing through the center of the retainer ring, the rotary ring being secured to the retainer ring, the stationary ring being located on the rotary ring, wherein the first pressing member is located at a position where the retainer ring is most separated away from the substrate to allow the first pressing member to press the polishing pad to form a first raised portion of the polishing surface that applies a first local repulsive force of the polishing pad to a first local position of a periphery of the substrate, the second pressing member is located at a position where the retainer ring and the substrate are in contact to allow the second pressing member to press the polishing pad to form a second raised portion of the polishing surface that applies a second local repulsive force of the polishing pad to a second local position of the periphery of the substrate, the second local position being at a radial distance from an outermost edge of the substrate different from a radial distance of the first local position from an outermost edge of the substrate, the first pressing member is arranged at an upstream side of the retainer ring in a moving direction of the polishing surface, and the second pressing member is arranged at a downstream side of the retainer ring in the moving direction of the polishing surface, the first pressing member is located at one side of a reference linear line, the second pressing member is located at other side of the reference linear line, the reference linear line passes through a center of the retainer ring and a center of the polishing table, and the first pressing member and the second pressing member are arranged along the moving direction of the polishing surface, the first pressing member and the second pressing member are located on the linear line perpendicular to the reference linear line and passing through the center of the retainer ring.

2. A method comprising:

rotating a polishing table supporting a polishing pad;

pressing a substrate against a polishing surface of the polishing pad with a pressing surface of a head body, while rotating the head body;

pressing a retainer ring against the polishing surface while rotating the retainer ring together with the head body and the substrate, the retainer ring surrounding the substrate, the retainer ring having an inner diameter larger than a diameter of the substrate; and polishing the substrate while rotating a rotary ring together with the retainer ring and applying a local load to a stationary ring from a first pressing member or a second pressing member of dual pressing members consisting of the first pressing member and the second pressing member, the first pressing member and the second pressing member being located on a linear line passing through the center of the retainer ring, the linear line being perpendicular to a reference linear line passing through a center of the retainer ring and a center of the polishing table, the rotary ring being secured to the retainer ring, the stationary ring being located on the rotary ring, wherein the first pressing member is arranged at an upstream side of the retainer ring in a moving direction of the polishing surface, and the second pressing member is arranged at a downstream side of the retainer ring in the moving direction of the polishing surface, and selecting either the first pressing member or the second pressing member to apply a local load to the stationary ring, wherein the first pressing member is located at a position where the retainer ring is most separated away from the substrate to allow the first pressing member to press the polishing pad to form a first raised portion of the polishing surface that applies a first local repulsive force of the polishing pad to a first local position of a periphery of the substrate, and the second pressing member is located at a position where the retainer ring and the substrate are in contact to allow the second pressing member to press the polishing pad to form a second raised portion of the polishing surface that applies a second local repulsive force of the polishing pad to a second local position of the periphery of the substrate, the second local position being at a radial distance from an outermost edge of the substrate different from a radial distance of the first local position from an outermost edge of the substrate.

* * * * *